United States Patent [19]

Thompson

[11] Patent Number: 4,823,967

[45] Date of Patent: Apr. 25, 1989

[54] CLOSURE FOR CONTAINER AND METHOD FOR FORMING THE CLOSURE

[75] Inventor: Mortimer S. Thompson, Maumee, Ohio

[73] Assignee: Tri-Tech Systems International Inc., Maumee, Ohio

[21] Appl. No.: 63,119

[22] Filed: Jun. 17, 1987

Related U.S. Application Data

[63] Continuation-in-part of Ser. No. 61,100, Jun. 10, 1987, abandoned.

[51] Int. Cl.[4] ..... B65D 41/06

[52] U.S. Cl. ..... 215/222; 215/31; 215/344; 215/DIG. 1; 264/163; 264/296

[58] Field of Search ..... 215/222, 223, 344, DIG. 1, 215/342, 31; 264/163, 296, 295

[56] References Cited

U.S. PATENT DOCUMENTS

| | | |
|---|---|---|
| 521,788 | 6/1894 | Flanigan . |
| 958,513 | 7/1910 | Love . |
| 1,770,548 | 7/1930 | Oven . |
| 2,340,353 | 2/1944 | Weaver . |
| 2,385,105 | 5/1959 | Heyl et al. . |
| 2,423,295 | 7/1947 | Crabbe et al. . |
| 2,447,340 | 8/1948 | Jackson . |
| 2,456,560 | 12/1948 | Keith . |
| 2,852,054 | 9/1958 | Motley . |
| 2,961,119 | 11/1960 | Leach . |
| 3,038,624 | 6/1962 | Wieckmann . |
| 3,065,677 | 11/1962 | Loeser . |
| 3,171,453 | 3/1965 | Strong . |
| 3,200,981 | 8/1965 | Harding . |
| 3,243,851 | 4/1966 | Reitter, Jr. et al. . |
| 3,250,417 | 5/1966 | Powers, Jr. et al. . |
| 3,272,369 | 9/1966 | Grimsley . |
| 3,285,452 | 11/1966 | Moloney et al. . |
| 3,286,866 | 11/1966 | McIntosh . |
| 3,339,770 | 9/1967 | Weigand . |
| 3,343,700 | 9/1967 | Heubl . |
| 3,344,942 | 10/1967 | Hedgewick . |
| 3,348,717 | 10/1967 | Treanor . |
| 3,352,127 | 11/1967 | Skinner, Sr. . |
| 3,352,448 | 11/1967 | Livingstone . |
| 3,361,551 | 1/1975 | Hannon . |
| 3,374,913 | 3/1968 | Zipper . |
| 3,405,439 | 10/1968 | Uemura . |
| 3,418,409 | 12/1968 | Hesse et al. . |
| 3,460,708 | 8/1969 | Leftault, Jr. . |
| 3,482,725 | 12/1969 | Exton . |

(List continued on next page.)

FOREIGN PATENT DOCUMENTS

| | | |
|---|---|---|
| 764429 | 3/1971 | Belgium . |
| 0049876 | 10/1981 | European Pat. Off. . |
| 1811318 | 7/1969 | Fed. Rep. of Germany . |
| 2829755 | 1/1980 | Fed. Rep. of Germany . |
| 3523771 | 1/1987 | Fed. Rep. of Germany . |
| 555488 | 3/1923 | France . |
| 2306135 | 4/1976 | France . |
| 2378689 | 1/1978 | France . |
| 351515 | 1/1961 | Switzerland . |
| 607702 | 8/1975 | Switzerland . |
| 788148 | 8/1956 | United Kingdom . |
| 930866 | 8/1956 | United Kingdom . |
| 1024762 | 10/1962 | United Kingdom . |
| 1048727 | 3/1965 | United Kingdom . |

OTHER PUBLICATIONS

Cryogenics (Jul. 1980)—M. Shinohara, T. Kugo, and K. Ono, Superleak—Ti ght Stainless Steel Hollow, O-Ring Seals for Cryogenic Use.

*Primary Examiner*—Donald F. Norton

*Attorney, Agent, or Firm*—Hedman, Gibson, Costigan & Hoare

[57] ABSTRACT

A cap for a container having a depending wall with a free end adapted to constantly urge engaging means of the cap and the container together upon engagement therebetween. Preferably, the free end of the cap has low hoop stress when axially compressed to provide spring means which perform the required function. In forming the cap, preferably one end is attached at the top wall of the cap, its other end is free to move relative to the cap and a substantial horizontal intermediate element is provided therebetween. In use, the free end has a bearing surface at or beyond the horizontal element thereof.

28 Claims, 6 Drawing Sheets

U.S. PATENT DOCUMENTS 3,532,786 10/1970 Coffman .
3,557,275 1/1971 Longshaw ..... 264/296
3,557,985 1/1971 Denis et al. ..... 215/222
3,557,985 1/1971 St. Denis et al. .
3,567,233 3/1971 Stephanich .
3,612,324 10/1971 Malick .
3,613,929 10/1971 Treanor .
3,784,041 1/1974 Birch .
3,820,799 6/1974 Abbes et al. .
4,016,996 4/1977 Aichinger et al. .
4,069,937 1/1978 Smalley .
4,090,631 5/1978 Grussen .
4,091,948 5/1978 Northup ..... 215/222
4,141,463 2/1979 Smith .
4,143,785 3/1979 Ferrell .
4,153,172 5/1979 Bialobrzeski .
4,196,818 4/1980 Brownbill .
4,202,462 5/1980 Imber .
4,206,852 6/1980 Dunn et al. .
4,209,102 6/1980 Dunn et al. .
4,210,251 7/1980 Grussen .
4,218,067 8/1980 Halling .
4,253,581 3/1981 Aichinger et al. .
4,257,525 3/1981 Thompson .
4,274,544 6/1981 Westfall .
4,281,774 8/1981 Mumford .
4,281,979 8/1981 Doherty .
4,290,614 9/1981 Moll .
4,343,408 8/1982 Csaszar .
4,345,692 8/1982 Obrist et al. .
4,360,114 11/1982 Owens .
4,360,149 11/1982 Hein .
4,386,044 5/1983 Arndt et al. .
4,392,579 7/1983 Uhlig et al. .
4,394,918 7/1983 Grussen .
4,418,828 12/1983 Wilde et al. .
4,442,947 4/1984 Banich, Sr. .
4,470,513 9/1984 Ostrowsky .
4,475,274 10/1984 Beckstrom et al. .
4,497,765 2/1985 Wilde et al. .
4,506,795 3/1985 Herr .
4,550,844 11/1985 Lininger .
4,552,279 11/1985 Mueller et al. .
4,563,325 1/1986 Coffman .
4,595,547 6/1986 Herr ..... 264/163 X

CLOSURE FOR CONTAINER AND METHOD FOR FORMING THE CLOSURE

This is a continuation-in-part of application Ser. No. 07/061100, filed June 10, 1987, now abandoned.

FIELD OF THE INVENTION

This invention relates to twist closures for containers and to means to assure consistent levels of sealing performance and application and uncapping torques. The invention also relates to methods of forming such caps and to child resistant closures.

BACKGROUND OF THE INVENTION

A great deal of attention has been focused by the packaging industry on efforts with twist caps to achieve consistent closure sealing performance and consistent levels of capping torques. A basic problem exists with the construction of the closures and with the methods and machinery used to apply caps to containers. This problem results in large variations of the torque required by the consumer to remove such caps so that some demand unusual strength or special implements while others may be so loosely applied that the effectiveness of their seal has been compromised.

With threaded closures it is typical that they are applied by capping machinery which turns the cap onto the container neck until a pre-set torque level required to assure an adequate seal is obtained. The required torque level is arrived at when the threaded engagement of the closure reaches the point where the liner or linerless sealing feature is compressed by the container neck rim to a level where the threads are so compressed against one another that they resist further engagement. Typically, the capping machine may be adjusted to provide a given capping torque level. However, most capping machines have a limited sensitivity to detect and disengage at a consistent level of torque. Some machines (e.g., those with magnetic clutches) are superior in this regard but still are lacking in consistency and are expensive. A major reason for the lack of consistency by capping machines lies in the normal variation in dimensions, surface lubricity, etc., in both caps and container neck finishes within the specifications employed for their quality control in production.

Typically, metal lug twist caps are applied to neck finishes which include a positive stop so that a limit is provided beyond which the cap cannot be twisted. The reason for such provision is that such lug engagement are short in span and, at the segment where seal compression takes place, low in pitch so that without a positive stop, the lug engagement could be exceeded and the cap would not be engaged. However, even with a positive stopping provision, wide variations in sealing force and uncapping torques are still experienced. This condition is made more severe by the high stiffness of metal and of glass containers which are typically employed for lug caps.

In general, plastic twist caps with lug engagement are seldom used where high seal integrity is needed because of the very high levels of localized stress and the resultant cold flow or creep which occurs to cause the caps to go out-of-round and to loose their sealing force. However, some use for lug type plastic caps has been developed by employing specially configured separate liners which incorporate a plug seal, a spring portion to act against the container rim and a positive stop so that very little stress is required for closure engagement, since the plug seal does not require a positive axial stress for its sealing engagement. Such caps find use for packaging dry products, primarily for prescription drugs and their design is directed towards making the closure child resistant by including a positive locking means which requires that the cap be pushed down and turned before it can be removed. Attempts to develop a one-piece closure wherein the integral liner also acts as a spring portion (see, U.S. Pat. No. 4,091,948) have been unsuccessful largely due to the fact that they have been unable to achieve the required level of flexibility and recoverable deformation in the integral liner.

In reference to the existing two-piece push-and-turn child resistant closures, problems exist with the inability of many adults to open such closures due to a lack of strength in their fingers. This fact has resulted in the use of separate caps for the same package—one child resistant and the other non-child resistant, or in the use of a two-sided cap where each side has the different feature. Both approaches are expensive and inconvenient.

Thus, known twist closures are beset with problems and drawbacks associated with their need to perform while having coacting surfaces with wide dimensional tolerance and surface lubricity, limited capping machinery sensitivity and inflexible materials resulting in specially configured and expensive liners, poor sealing performance and difficulty in opening.

SUMMARY OF THE INVENTION

In accordance wit the present invention, there is provided a new and unique closure consisting of a container and a unitary twist cap having a provision for producing a uniform level of capping and uncapping torque and sealing force. The cap is substantially rigid and includes plastic material and has a top wall which covers the container opening. The top wall has a depending skirt which engages the finish of the container for closure thereof and which has a positive stopping means to coact with a positive stopping means on the neck finish of the container. Spaced inwardly from the skirt and depending from the top wall of the cap is an integral spring portion which acts against the container neck and is employed in concert with the positive stopping means of the closure to stop and align the cap and container neck finish to predetermined levels of sealing force and capping torque. The integral spring portion has a high level of recoverable deformation or resiliency as a result of provisions in its design which significantly reduce its strength in the hoop direction while maintaining its strength in the adial direction. As the cap is twisted onto the container neck for closing, the spring portion compresses to provide a positive force to effect the engagement of the closure stopping means at the predetermined level of sealing force and capping torque. Preferably the closure engaging means consists of threads or lugs and the closure stopping means consists of suitable coacting projections and recesses on the neck finish and skirt inner wall.

In a preferred embodiment, the spring portion of the cap is an annular wall which depends from the lid and has a free end which is curled outwardly to provide at least about a quarter-round radial cross section which engages the rim of the container in an axial compressive engagement. Such a spring portion has a generally horizontal element at or intermediate the area of its engagement with the container rim and its attachment site on the top wall and, as a result, it provides a high level of resiliency in the axial direction. Optionally, the radial cross section of the spring portion may be a more fully curled "U" shape or "O" shape. It may also be essentially inarcuate in the region of said generally horizontal intermediate element. Optionally, the spring portion may have radial slits to facilitate its use or may have circumferential corrugations for the same reason. Optionally, the spring portion may also serve as a linerless rim seal, or it may be used in conjunction with a separate linerless plug seal which depends from the top wall to sealingly engage the bore of the container neck. In another option, the depending annular wall may have a free end which includes axial slits and which is bent outwardly to form generally horizontal flaps which act as a peripheral series of cantilevered springs. In a method for forming the cap and spring portion of this embodiment, the cap preferably is formed first by conventional molding techniques, such as injection or compression molding, with an internal preform for the spring portion. The preform includes an annular wall which is spaced inwardly from the peripheral skirt and which is integral with and depends from the lid. Thereafter, the free end is turned outwardly by reforming means which compressively engages its lip. To produce a generally quarter-round cross section, a curling tool may be used. To produce a "U" shape, the curling tool has provision to then turn the lip of the free end upwardly upon further compression. To produce an "O" shape, the preform is further compressed by the curling tool and the lip of the free end curls inwardly and completes the "O" shape as a result of the stresses imposed by its plastic memory. Optionally, slits can be produced in the curled spring portion during its initial molding, during curling by cutting edges included in the curling tool, or subsequently in a separate operation. To produce generally horizontal flaps, the free end may include slits around its periphery and at least the slitted portion is turned outwardly by compressive engagement with a reforming tool. Optionally, the slits may be created during the reforming by the tool itself. Optionally, circumferential corrugations can be produced in the spring portion during molding or by employing suitable forming tool surfaces.

In another preferred embodiment, the spring portion of the cap is an annular wall which depends from the top wall in a downwardly and outwardly direction. Its radial cross section may be straight or arcuate. In this embodiment, provision for reducing the hoop strength of the spring portion to enhance its level of resiliency in the axial direction is made by including radial slits or slots around its periphery. A separate linerless plug seal may depend from the top wall to engage the bore of the container neck for sealing purposes. Optionally, the spring portion may have circumferential corrugations to enhance its function. In a method for forming the cap of this embodiment, the cap preferably is molded by conventional molding techniques, in molds which have provision to produce the desired slots during molding. Optionally, the desired slits may be produced after molding employing tools with appropriate cutting edges.

In another embodiment of the invention, the closure also includes a positive locking means which requires a closure manipulation additional to twisting to unlock and remove the cap. The closure requires an axial displacement of the cap relative to the container to unlock their engagement prior to cap removal by twisting. Preferably, the axial displacement of the cap may be accomplished by pressing on a restricted portion of the cap lid with the locking mechanism therebelow so that a lower level of unlocking pressure may be employed while allowing maximum amount of sealing pressure.

In another embodiment, the closure may include a locking mechanism in one position of engagement and may have another position of engagement which is not locked. Preferably, the cap has a single bore with a top and a depending skirt including the engaging and locking means. Optionally, the locking means may be located on the container neck finish. Optionally, the cap may have two bores with a mutual top and an upwardly projecting skirt and a downwardly depending skirt wherein one skirt includes a locking means and its opposing skirt does not and the cap is inverted to switch from a locked engagement with the container to an unlocked engagement.

In another embodiment, the container is fitted with a curled portion at its rim which may have a U-shaped cross-section. The rim may also be provided with a depending annular ring which is adapted to depress the curled portion to thereby provide significant axial compression to effect engagement and disengagement of the cap from the container. The neck lip or rim may also be provided with a horizontal flange which can be depressed by the depending wall of the cap.

BRIEF DESCRIPTION OF THE DRAWINGS

The following is a detailed description together with accompanying drawings of illustrative embodiments of the invention. It is to understood that the invention is capable of modification and variation apparent to those skilled in the art within the spirit and scope of the invention.

DETAILED DESCRIPTION OF THE INVENTION

Referring to FIGS. 1 to 4, there is shown a cap 10 and a coacting container neck 38 of the invention.

Figure 1:
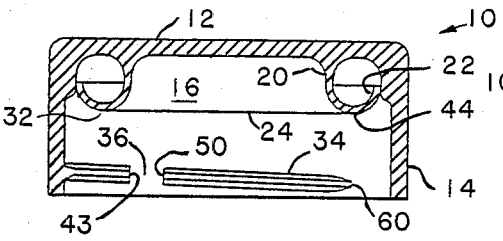
FIG. 1 is a longitudinal sectional view of one embodiment of the cap of the invention.
Figure 2:
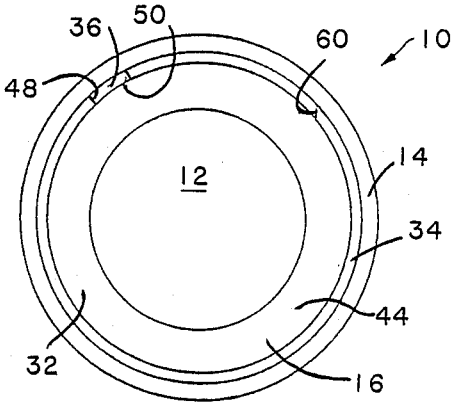
FIG. 2 is a plan view of the cap of FIG. 1
Figure 3:
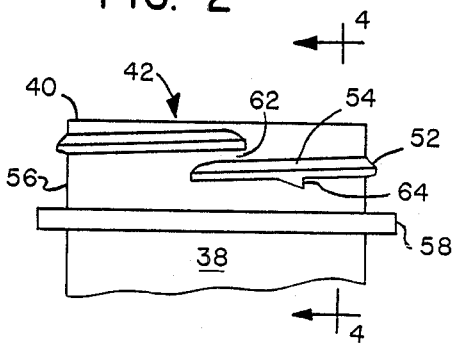
FIG. 3 is a longitudinal view of a container, such as a bottle neck, upon which the cap of FIG. 1 can be applied.
Figure 4:
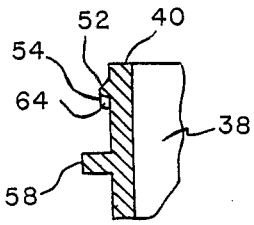
FIG. 4 is a sectional view of FIG. 3, taken along the lines 4—4.

Referring first to FIGS. 1 and 2, there is shown a semi-rigid cap 10 of plastic having a lid 12, a depending peripheral skirt 14 including an internal thread 34 having a lead-in 60 and a recess 36 therein, and an integral curled or curved spring portion 16 which also provides a sealing surface 32. The illustrated spring portion 16 has an upper end 20 integral with the lid 12, a free end 22 and an intermediate element 44, which is generally horizontal, and has a large amount of compressibility. The recess 36 in the thread 34 has a generally vertical or circumferentially directed stopping face 48. FIGS. 3 and 4 show a container neck 38 having a transfer bead 58 and a side wall 56 including an external thread 52 having a projection 54 thereunder.

Figure 5:
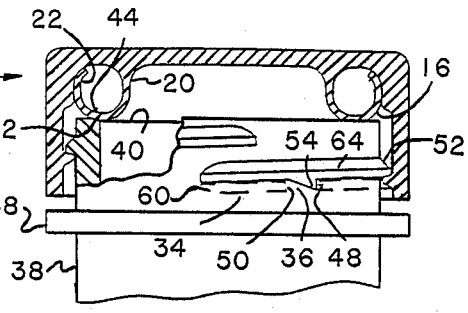
FIG. 5 illustrates the closing of the cap of FIG. 1 on the container of FIG. 3.

FIG. 5 shows the cap 10 of FIGS. 1 and 2 in closed and sealed engagement with the container neck 38 of FIGS. 3 and 4. To produce the closed engagement of cap 10 and neck 38 the lead-in 60 of the cap thread 34 engages the neck thread 52 and is turned and moves downwardly until it reaches the neck thread projection 54 at which point there is little or no compression of the cap spring portion 16. Without such compression and because there is sufficient clearance at the neck portion 62 between neck thread 52 where it overlaps, the cap thread lead-in 60 moves past the neck thread projection 54 with its stopping face 64. At this juncture, the cap spring portion 16 begins to develop significant compression and to exert significant pressure on the neck projection 54 by the cap thread 34. As the capping operation continues, when this compression and pressure reach a level which is well above that required for suitable sealing, the cap thread gap 36 reaches the neck thread projection 54 and the two threads are snapped into a continuous peripheral engagement at a specific and desired sealing force whereupon the capping operation positively stops as cap thread stopping face 48 meets the neck thread stopping face 64. The amount of compressibility of the spring portion 16 is large to allow a sufficient height to the neck projection stopping face 64 to provide a consistent buttressing surface to the cap stopping face 48 while providing additional compressibility to produce a significant sealing force and seal integrity. The preferred level of recoverable compressibility is well in excess of that achieved by typical cap liners and linerless rim seals and ranges from 0.020 to 0.100 inches and higher. Such high levels of compressibility derive from the curved cross section of the spring portion 16 and the fact that the sealing pressure is exerted at surface 32 which is close to or beyond the horizontal element 44. Such a shape for spring portion 16 results in its largely axial deformation during use with allow level of localized strain or resiliency needed for the successful operation of the spring portion 16 and for the development of a significant sealing force.

Figure 6:
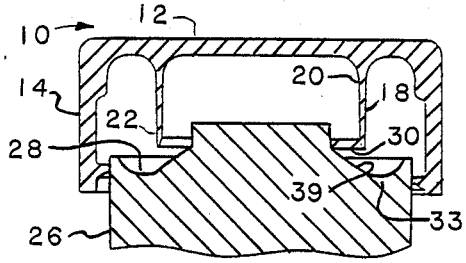
FIG. 6 is a longitudinal sectional view of one embodiment of the method of the invention, illustrating a preformed cap of the invention and a tool for curling the free end of the depending wall of the cap.
Figure 7:
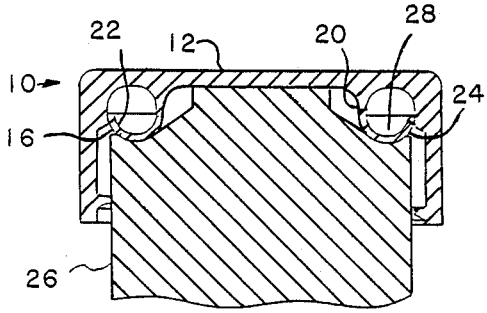
FIG. 7 generally is the same as FIG. 6, except that the tool has engaged and formed the curled free end in the depending wall of a cap of the invention.

Referring to FIGS. 6 and 7, there is shown a preferred method of forming the curled portion 24 of the curved spring portion 16. In FIG. 6, the cap 10 already has been formed by conventional molding techniques, such as injection molding, with a vertical cylindrical or tubular wall 18 having its upper end 20 integral with the lid 12 and with its lower free end 22 ready for curling by the illustrated curling tool 26. As shown in FIG. 6, there is a taper in lower end 22 extending from the rim 30 which facilitates the initiation of the curl 24 and the wall 18 and the curl 24 are free of abrupt changes in thickness.

The curled portion 24 of the seal 16 is formed with a curling tool 26, which in FIG. 6 has been positioned within the cap 10 ready to engage the preformed wall 18 at its lip or rim 30. The curling tool 26 includes a circular or annular groove 28 of a concave cross section suitable for shaping and dimensioning the curled portion 24.

As shown in FIGS. 6 and 7, the forming operation is accomplished by pressing the groove 28 of the tool 26 against the rim 30 of the wall 18. In this embodiment, the deepest portion 33 of the groove 28 representing the center of its concavity is located outwardly of the cylindrical plane of the wall 18. Also the groove 28 has a slanted portion 39 inwardly and tangent to its concavity to facilitate centering of the tool and cap. As movement of tool 26 relative to the wall 18 are centered within groove 28 by the slanted portions 39 and are then forced outwardly and then upwardly to assume the desired curved shape having a curved cross section of from about 90 to 360 degrees but preferably from about 180 to 240 degrees, but in all . cases including a generally horizontal element 44 of the curled spring portion 16 has a measurable radial span.

To facilitate the curling operation, in the case of polypropylene, the tool 26 may be at a temperature of about ambient to about 300 degrees F. but preferably about 150 to about 300 degrees F. for curling cycles of about one-half to two seconds. The curl radius of the groove 28 and the resultant spring portion 16 may range from 0.040 to 0.100 inches or larger when used in conjunction with wall 18 thicknesses of about 0.005 to 0.030 inches. The thickness of wall 18 may desirably be tapered to include free ends 22 of about 0.005 to 0.015 inches and upper ends 20 of from 0.015 to 0.030 inches.

Figure 8:
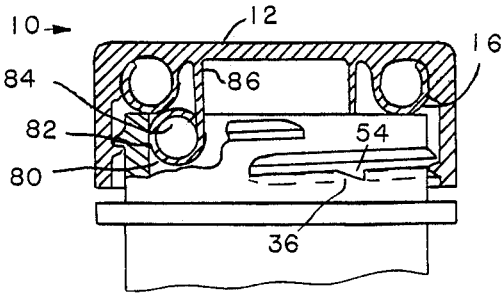
FIG. 8 is a longitudinal view, partly in section, of another embodiment of the cap of the invention, wherein the cap also includes a plug seal having a curled free end.

In FIG. 8, there is shown the cap 10 of FIG. 1, 2 and 5 wherein a separate curled linerless plug seal 80 as described in my copending application Ser. No. 809,058 is included, the entire disclosure of which is incorporated herein by reference. The plug seal 80 is formed by curling to produce a curled free end 84 with an outer sealing surface 80 and depends from lid 12 by its attached upper end 86. The seal 80 is used to supplement the spring seal 16 with those containers having suitable neck inside surfaces 46.

Figure 10:
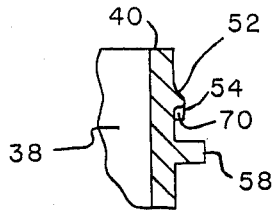
FIG. 10 is sectional view of FIG. 9, taken along the lines 10—10.
Figure 9:
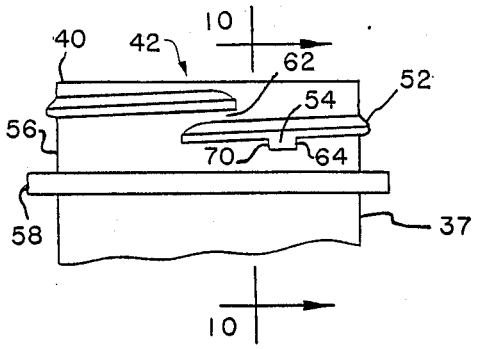
FIG. 9 is a longitudinal view of another bottle neck which can be used in combination with the caps of the invention.
Figure 11:
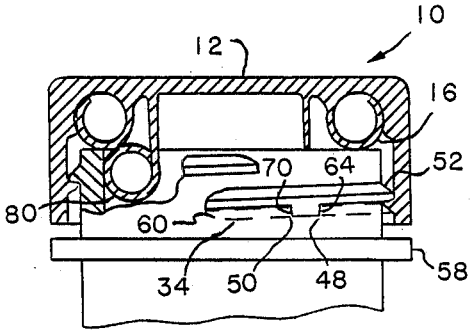
FIG. 11 is a longitudinal view partly in section of the cap of FIG. 8 on the container of FIG. 9.

Referring now to FIGS. 9 to 11, there is shown a neck finish 37 which is similar to the neck 38 illustrated by FIGS. 3 to 5 except that a positive locking means 70 has been included in neck stopping means projection 54. When the cap 10 of FIGS. 1, 2 and 5 is applied to the neck finish 37 the threading operation continues until the neck stopping means face 64 stops further thread movement by engaging the cap stopping means face 48 whereupon the neck locking means 70 is in opposition to the cap locking means 50. In order to disengage such opposition, the cap 10 must be pressed axially against the neck 37 whereupon the curved spring portion 16 compresses to allow the cap locking means 50 to pass the neck locking means 70 when turned.

Figure 12:
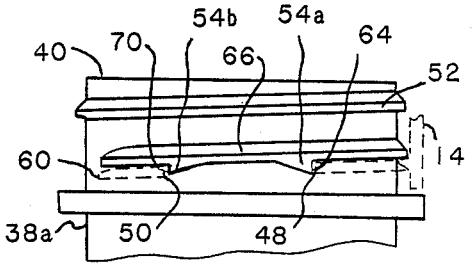
FIG. 12 is a longitudinal view of an embodiment of a container which can be used in combination with the caps of the invention.
Figure 13:
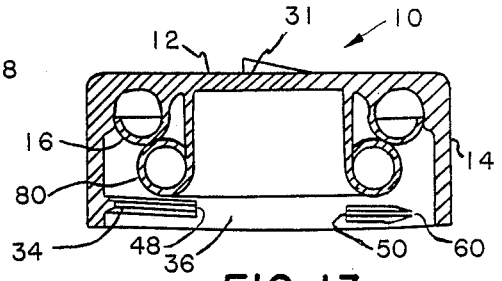
FIG. 13 is a longitudinal sectional view of a cap of the invention which can be used with the container neck of FIG. 12.

Referring now to FIGS. 12 and 13, there is shown a container neck **38*a* having separate projections 54*a*, used for stopping engagement and 54*b*, usedfor locking engagement with similar recessed means 36 in the cap 10 including cap stopping face 48 and locking face 50. The projections 54*a* and 54*b* are spaced apart along neck thread 52 by a thread portion 66. The cap 10 is applied and removed from the neck finish 38*a* in the same manner as in FIG. 9. However, in this embodiment, the cap 10 may be reapplied in an unlocked but otherwise secure position by reapplying cap 10 until the lead-in portion 60 is located along the neck thread portion 66 between projections 54*a* and 54*b*. In this position, the spring portion 16 is compressed enough to provide a seal as well as a positive seating of the cap thread 34 against the neck thread 52. However, there are no locking faces in opposition and the cap 10 may easily be removed without special manipulation. Alternatively, where desired the cap 10 may be reapplied to the locked position. Optionally, the cap lid 12 may include an indicating means 31 on its upper surface above the locking face 50 so that the cap lid 12** may be pressed downwardly only at that point to unlock the cap. In this manner, much lower pressures are required to unlock the cap without compromising its intended child resistant use.

Figure 14:
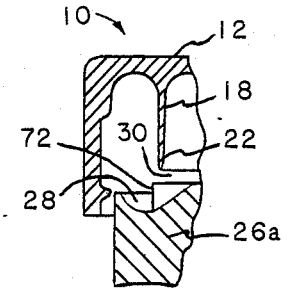
FIG. 14 is a longitudinal sectional view of a portion of another embodiment of a preform of the cap about to be engaged by a forming tool of the invention.
Figure 15:
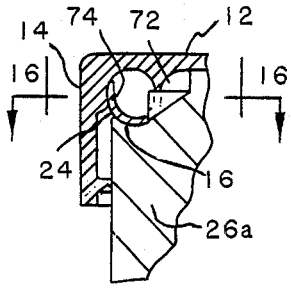
FIG. 15 is similar to FIG. 14, except that the forming tool has caused the depending wall of the cap to be curled and slit.
Figure 16:
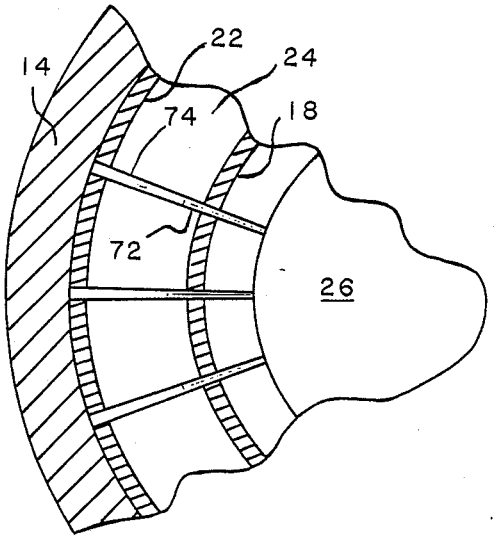
FIG. 16 is a plan view of FIG. 15, taken along the lines 16—16 of FIG. 15.

Referring now to FIGS. 14 to 16, there is shown an alternative method for producing the spring portion 16 of cap 10 wherein the curling tool **26*a* has peripherally spaced cutting edges 72 located in groove 28. As shown in FIG. 15, as the rim 30 of preform wall 18 enters the groove 28, it meets the cutting edges 72 which slit it axially so that after the curl 24 has been formed virtually all its hoop strength has been removed by its peripherally spaced slits 74. In this manner, the resiliency of the spring 16** may be further enhanced while relying on a separate linerless plug seal for sealing.

Figure 17:
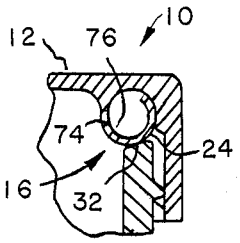
FIG. 17 is a longitudinal sectional view of a portion of the formed cap of FIG. 15 in engagement with a container.

In FIG. 17 there is shown an alternative method for producing peripheral slits in the spring portion 16 wherein the curl 24 is produced as illustrated by FIGS. 6 and 7 and in a sequential operation the tool **26*a* of FIGS. 14 to 16 is pressed against the already formed curl 24 so that the slits 74 occur only in the intermediate spring portion 76**.

Figure 18:
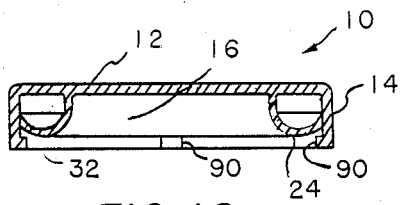
FIG. 18 is a longitudinal sectional view of a child resistant cap of the invention.
Figure 19:
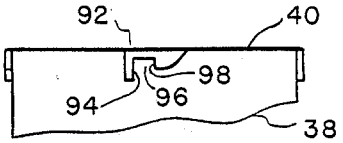
FIG. 19 is a longitudinal view of a portion of a container for child resistant caps of the invention.
Figure 20:
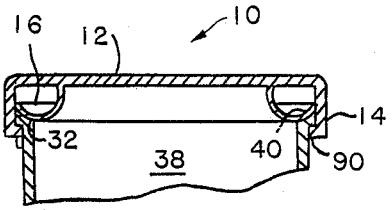
FIG. 20 is a longitudinal sectional view of the cap of FIG. 18 on the container of FIG. 19.

Referring now to FIGS. 18 to 20, there is illustrated a cap 10 including an integral spring portion 16 having a curled free end 24 with a sealing portion 32 and lugs 90 used to secure the cap to a container neck 38. Disposed about the periphery of rim 40 of neck 38 are lugs 92 shaped with a recess 96 to receive and coact with the lugs 90 of the cap 10. The recess 96 has a stopping face 94 and a locking face 98 to prevent cap removal without first pressing the cap downwardly to free the cap lug 90 from the container lug recesses 96.

Figure 21:
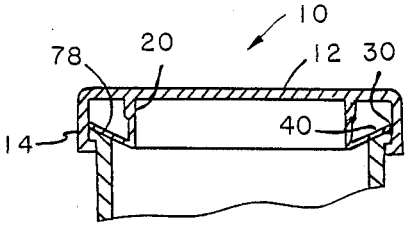
FIG. 21 is a longitudinal sectional view of an assembled cap and container of the invention.
Figure 22:
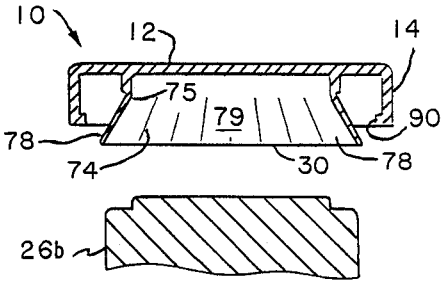
FIGS. 22 and 23 are longitudinal sectional views illustrating the forming of the cap of FIG. 21.
Figure 23:
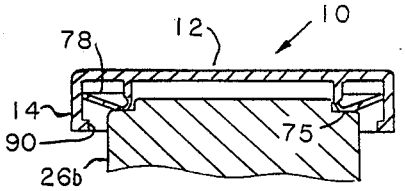

FIGS. 21 to 23 illustrate an alternative spring portion 16 to the cap 10 illustrated in FIGS. 18 to 20 in which generally horizontal flaps 78 are attached to the lid 12 through a short annular wall 20 and coact in a cantilevered manner with the rim 40 of container neck 38. The flaps 78 are separated by slots 74 which may be molded in or formed subsequently. FIGS. 22 and 23 show how the spring portion .6 formed by bending the flaps 78 outwardly and upwardly from the as-molded position which forms a generally conical structure 79 employing the tool **26*b*. Heat may optionally be employed to reduce the strain created by bending at the hinge portion 75. The flaps 78 may also be long enough so that they will be held in a generally horizontal position by the abutment of their rims 30 with the skirt 14. Preferably, the generally horizontal, flaps of spring portion 16** range from 0 to 30 degrees above the horizontal although it will perform adequately outside of this range.

Figure 24:
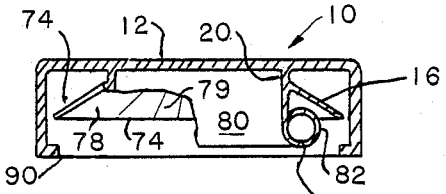
FIG. 24 is a longitudinal sectional view of another embodiment of the cap of the invention.
Figure 25:
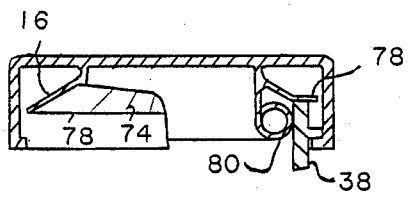
FIG. 25 is a longitudinal sectional view illustrating the engagement of the cap of FIG. 24 with a container.

FIGS. 24 and 25 illustrate how the as-molded conical structure 79 of FIGS. 21 to 23 may be employed as a spring portion 16 without reforming to a generally horizontal position. Since the slits 7.4 have removed almost all of the hoop strength and, therefore, resistance to spread deformation of the conical structure 79, the structure can operate effectively as a spring portion 16 at a much greater angle from the horizontal. As a result, the conical structure 79 is suitable for use as spring portion 16 in shapes and wall angles suitable for molding and withdrawal from molds without subsequent bending or curling, which would not be possible without the inclusion of the slits 75 therein. This makes possible conical walls more closely approaching the vertical in one direction as well as the horizontal in the other. Preferred wall angles for conical structure 79 with slits 74 when used for the spring portion 16 as molded and without reforming may therefore be preferably about 0 to 70 degrees from the horizontal. Also shown in FIGS. 24 and 25 is the curled plug seal 80 which shares its attachement with the spring portion 16 to lid 12 through upper wall 20. During the curling operation which forms the plug seal 80, the flaps 78 may be bent upwardly to a more horizontal position as a result of the upward pressure by the curl 84 of the plug seal 80 as it is being formed. Alternatively, the curling tool 26 may also directly bend the flaps 78 upwardly during the formation of the plug seal curl 84.

Figure 26:
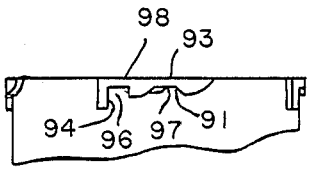
FIG. 26 is a longitudinal view of a child resistant or easily accessible container of the invention.
Figure 27:
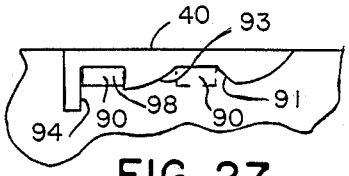
FIG. 27 is similar to FIG. 26 except it illustrates the operation of the container of FIG. 26 and cap of FIG. 24.

Referring now to FIGS. 26 and 27, there is shown a container neck 38 similar to that described in FIGS. 18 to 20 except that the lug 92 has two recesses 96 and 97. Recess 96 is the locking lug described in FIGS. 18 to 20 with a stopping face 94 and a locking face 98. In contrast, recess 97 has beveled restraining faces 91 and 93 which allow the cap 10 of FIG. 18 to engage the container neck 38 securely but without requiring an axial pressure to unlock it before uncapping. In this manner, the closure may alternatively or optionally be used in a locked or unlocked mode as individually desired.

Figure 28:
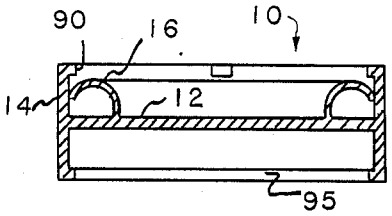
FIG. 28 is a longitudinal sectional view of the combination of a child resistant and easily accessible cap of the invention.

FIG. 28 shows the cap 10 as described in FIGS. 18 to 20 as one side of a two sided cap wherein its opposing side is a snap cap including a bead 95 which is used to engage the lugs 92 of the container neck 38 described in FIG. 19.

Figure 29:
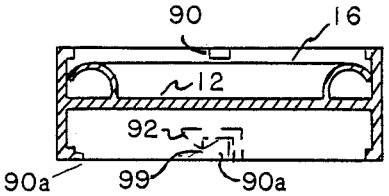
FIG. 29 is a longitudinal sectional view of another child resistant and easily accessible cap of the invention.

FIG. 29 shows the cap 10 described in FIGS. 18 to 20 as one side of a two sided cap wherein its opposing side is similar, except that its lugs 90*a* have a restraining face 99 which is beveled and which will not be locked by the opposing locking face 98 on the container neck 38.

Figure 30:
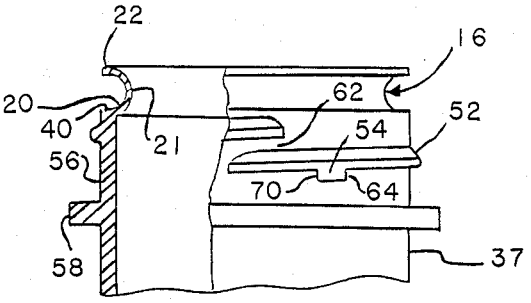
FIG. 30 is a partial sectional view showing an annular depression in the lip of the container formed of outwardly curled walls.
Figure 31:
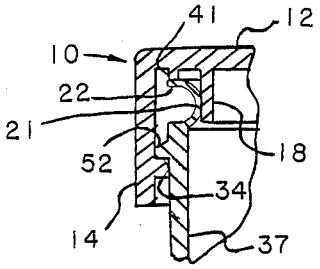
FIG. 31 is a longitudinal sectional view of a cap engaged to the container neck shown in FIG. 30.

Referring now to FIGS. 30 and 31 there is illustrated an embodiment of the invention wherein the container neck 37 described in FIG. 9 has been adapted to include a curled portion 16 at its rim. The curled portion 16 has a "U" shape cross section with an end 20 integral with the top 40 of the neck finish and a free end 22 with a curved intermediate portion 21 which provides a spring action upon axial compression. FIG. 31 shows the engagement of the neck 37 with a cap 10 having a lid 12 and one depending annular ring 18 which is a plug seal for engagement with the intermediate portion 21 of the curled spring portion 16, and a second depending annular ring 41 which is adapted to depress the free end 22 in a spring engagement to unlock the cap thread 34 from the neck thread 52. In this manner, the container curled spring portion 16 provides both an effective seal and an effective spring action for the practice of the invention. Alternatively, the curled spring portion 16 may be produced in the original molding of the container neck 37 using suitable shaped blow, injection or other molds without a subsequent curling operation as described for the curled spring portion 16 in FIGS. 6 and 7.

The curled portion is adapted to provide significant axial compression of at least about 0.030, preferably about 0.030 to 0.070 inches to allow for a significant butressing area on the locking and stopping surfaces and significant axial motion to effect their engagement and disengagement.

Figure 32:
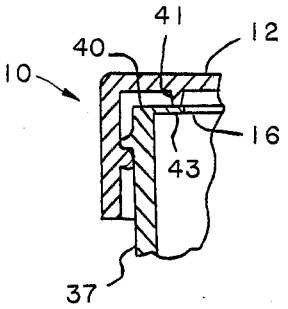
FIG. 32 is a longitudinal sectional view of a horizontal flange extending from the lip of the container and engaged by the wall of a cap.

Referring now to FIG. 32, there is shown another bottle neck 37 of the invention similar to the bottle neck 37 of FIGS. 30 and 31 except that it has a spring portion 16 which is an inwardly directed horizontal flange 43 integral with the neck lip 40. The cap lid 12 has a depending wall 41 which engages the spring portion 16 to create a seal and through which the spring portion 16 urges the cap and neck threads 34 and 52 together. The threads are separated to unlock the cap when the cap is depressed and the spring portion 16 yields.

Figure 33:
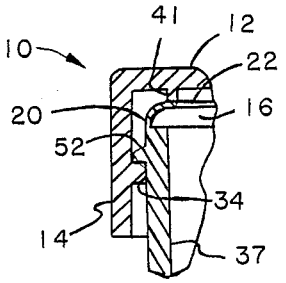
FIG. 33 is a longitudinal sectional view showing a curved flange extending from the lip of the container and engaged by the wall of a cap.

Referring to FIG. 33 there is shown another bottle neck 37 similar to that illustrated by FIGS. 30 and 31 except that its spring portion 16 is inwardly curled. When the cap 10 is depressed, the spring portion 16 yields and moves down to unlock the cap 10 from the neck 37.

Figure 34:
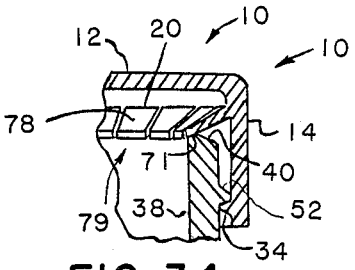
FIG. 34 is a longitudinal sectional view of a cap having horizontal elements integral with the depending skirt.

Referring now to FIG. 34, there is shown another embodiment wherein the cap 10 is similar to that described in FIG. 22 except that the generally horizontal flaps 78 used as spring portions-are integral with the cap skirt 14. The flaps are separated by slots 4 which facilitate their operation as cantilevered springs by significantly reducing the hoop strength of the generally conical structure 79 of the array of flaps 78. The neck rim 40 is slanted downwardly and outwardly to facilitate the spring action by placing the flap bearing surface 71 further from its attachment site 20 at the skirt 14.

In the production of the invention, the size of the caps typically can range from about 20 mm to 120 mm and bottle and/or jar sizes range from about 2 ounce to 128 ounce capacity. Larger capacity containers such as drums or kegs are also suitable for the practice of the invention as are smaller vials and other containers.

Useful plastics which can be used for forming the caps of the invention include polypropylene, polyethylene, polystyrene, acrylonitrile-styrene-butadiene polymers, and other semi-rigid to rigid plastic materials.

The caps also can include combinations of materials, e.g., caps having metal lid portions or portions utilizing different plastics. The caps of the invention can be used to close and seal a wide variety of containers for a wide variety of products and foods including:

beverages, including carbonated soft drinks and pasteurized beverages such as beer;

foods, especially those where container sealing performance is critical, including oxygen sensitive foods such as mayonnaise, peanut butter and salad oil, and including corrosive foods such as vinegar, lemon juice; and househould chemicals, including bleaches and detergents, drugs and cosmetics and other products requiring the highest integrity seal and reseal under the widest range of distribution and use conditions.

Further, the caps of the present invention can be used in conjunction with other features for caps, such as breakaway rings, including the caps having the breakaway or separable rings disclosed in my U.S. patent application, Ser. No. 809,057, the entire disclosure of which is hereby incorporated by reference.

The invention in its broader aspects is not limited to the specific described embodiments and departures may be made therefrom within the scope of the accompanying claims without departing from the principles of the invention and without sacrificing its chief advantages.

I claim:

1. A container-cap combination for containing a product comprising:

(a) a container comprising:

an opening for receiving or discharging the product, a neck surrounding the opening having engaging means thereon and including a lip, an annular flexible member integral with the lip adapted to be compressed in response to an axial compressive load applied to the lip, (b) a cap comprising;

a top wall, a depending skirt with engaging means thereon, and a depending wall spaced from the skirt and extending from the top wall to a free end which engages the annular flexible member of the container and is adapted to constantly urge the engaging means on the cap and the container together upon engagement therebetween.

2. The container-cap combination of claim 1, wherein the annular flexible member of the lip comprises a first end integral with the neck and a free end, and including an axially compressible wall intermediate to said first and free ends.

3. The container-cap combination of claim 2, wherein the cap further comprises a depending annular wall adapted to engage the intermediate portion of the annular flexible member of the container to thereby form a seal when the cap is secured to the container.

4. The container-cap combination of claim 3, wherein the cap further comprises an outer depending annular ring adapted to depress the free end of the annular flexible member of the container.

5. The container-cap combination of claim 4, wherein the free end of the annular flexible member is movable from a partially compressed position to a compressed position thereby disengaging the engagement means of the cap and container and wherein the distance that the free end moves from the partially compressed position to said compressed position is from about 0.030 to 0.070 inch.

6. The container-cap combination of claim 1, wherein the annular flexible member comprises a horizontal element and the depending wall of the cap is adapted to exert downward pressure on the horizontal element.

7. The container-cap combination of claim 2, wherein the intermediate portion is curved outward away from the opening of the container.

8. The container-cap combination of claim 2, wherein the intermediate portion is curved inward toward the opening of the container.

9. The container-cap combination of claim 1, wherein the annular flexible member of the container extends inwardly from and substantially horizontal to the lip of the neck.

10. The container-cap combination of claim 1, wherein the annular flexible member of the container extends upwardly and inwardly in a curvilinear manner from the lip of the neck.

11. A twist cap for a container having a stop means for controlling the closing of the twist cap thereon, comprising a top wall, a depending skirt with stop means adapted to engage the stop means on the container to limit the twisting of the cap onto the container, and an internal depending substantially continuous wall which circumscribes an open area therewithin and which includes spring means having an upper end at the top wall and a lower free end adapted to be moved relative to said upper end upon engagement between the stop means on the container and cap whereupon the free end flexes at relatively low hoop stresses.

12. The cap of claim 11, wherein said depending wall has a substantially horizontal element intermediate its ends.

13. The cap of claim 12, wherein said depending wall has a bearing surface adapted to be engaged by the container at said substantially horizontal intermediate element.

14. The cap of claim 11, wherein said free end is curled.

15. The cap of claim 11, wherein said free end is folded and slit to provide a hinge which can be flexed at low hoop stresses.

16. The cap of claim 11, wherein said free end is slit in the radial direction.

17. The cap of claim 11, wherein said free end also is adapted to seal upon engagement by a container.

18. The cap of claim 11, wherein said cap is child resistant.

19. The cap of claim 11, in combination with a container.

20. A method of forming a twist cap for a container having a stop means for controlling the closing of the twist cap thereon comprising:

forming a cap having a top wall, an outer depending skirt with stop means adapted to engage the stop means on the container, and an internal depending substantially continuous wall which circumscribes an open area within the inner wall and which includes spring means having an upper end at the top wall and a lower free end adapted to be moved relative to said upper end upon engagement between the stop means on the container and cap whereupon the free end flexes at relatively low hoop stresses.

21. The method of claim 20, comprising forming an intermediate substantially horizontal element between the ends of the inner wall.

22. The method of claim 21, comprising forming the depending wall with a bearing surface adapted to be engaged by the container at the substantially horizontal element.

23. The method of claim 20, comprising engaging and curling the free end to provide a curled free end.

24. The method of claim 20, comprising folding and slitting the free end to provide a hinged free end for flexing at low hoop stresses.

25. The method of claim 24, comprising slitting the free end of the radial direction.

26. A cap formed by the method of claim 20.

27. A child resistant cap formed by the method of claim 20.

28. A container-cap for containing a product comprising:

(a) a container comprising an opening for receiving or discharging the product, and a neck surrounding the opening having engaging means thereon and including a lip, (b) a cap comprising a top wall, a depending skirt with engaging means thereon, and a wall extending inwardly and downwardly from the skirt for engagement with the lip of the neck to constantly urge the engaging means on the cap and the container together upon engagement therebetween, and wherein said wall has radial slots therein for flexing thereof at low hoop stresses.

* * * * *